United States Patent [19]

Stoll

[11] Patent Number: 4,790,150

[45] Date of Patent: Dec. 13, 1988

[54] FLAT KNITTING MACHINE

[75] Inventor: Thomas Stoll, Reutlingen, Fed. Rep. of Germany

[73] Assignee: H. Stoll GmbH & co., Reutlingen, Fed. Rep. of Germany

[21] Appl. No.: 139,805

[22] Filed: Dec. 30, 1987

[30] Foreign Application Priority Data

Jan. 22, 1987 [DE] Fed. Rep. of Germany ..... 3701671

[51] Int. Cl.[4] ..... D04B 3/06

[52] U.S. Cl. ..... 66/125; 66/126 R

[58] Field of Search ..... 66/126, 126 A, 128, 66/127, 125, 146

[56] References Cited

U.S. PATENT DOCUMENTS 4,637,229 1/1987 Taylor ..... 66/146

*Primary Examiner*—Ronald Feldbaum

*Attorney, Agent, or Firm*—Larson and Taylor

[57] ABSTRACT

The flat knitting machine has the thread-leading ducts (15) which envelop the threads conveyed to the thread guides (10) and which with their thread exit point on the side nearest the thread guide are adaptable to the changing distance between thread guides (10) and needle bed ends.

10 Claims, 2 Drawing Sheets

FLAT KNITTING MACHINE

DESCRIPTION

The invention concerns a flat knitting machine with thread guides conveyable on guide rails arranged above the needle beds and with thread-leading members for guiding the threads from the needle bed ends to the thread guides.

In flat knitting machines, the threads have at times to be brought to the thread guides from the ends of the needle beds. This means that, where the needle beds are long, there are great distances over which the threads have to be conveyed freely; and in order to prevent the threads from sagging considerably, particularly when the carriage returns in the opposite direction to that of the thread supply, the threads must be kept under relatively high tension, which is however undesirable in view of the need to achieve clean stitch formation.

To avoid the above disadvantage it has already been proposed to arrange, parallel to each thread guide rail, at least one directing element in the form of a tensioned wire around which the thread is helically wound in at least one turn, with the result that it can be supported on this wire. However, here the threads still have to be wound round the wires and threaded into the thread guides by hand, and the thread still has to be kept under a notable tension so as to prevent the thread wound round the wire from forming, when the carriage returns, sagging loops which could collide with other threads on wires tensioned parallel thereto.

The invention sets out to construct the thread-leading members for guiding the threads from the needle bed ends to the thread guides in flat knitting machines in such a way as to reliably avoid, even with relatively low thread tension, collision between a conveyed thread and a neighbouring conveyed thread and sagging of a thread into the region of the needle beds.

The task is solved by the invention, in a flat knitting machine of the type mentioned in the introduction, by constructing the thread-leading members as a thread-leading duct which envelops the thread and which is adaptable, with its thread exit point on the side nearest the thread guide, to the changing distance between thread guides and needle bed ends, at least one of which ducts is allotted to each thread guide.

A thread-leading duct constructed according to the invention can advantageously be anchored with one of its ends on a stationary part of the flat knitting machine and with its other end coupled either firmly or detachably with a thread guide, and can for example consist of a telescopic tube, an at least zonally elastically flexible tube or of a hose at least zonally stiffened in its longitudinal direction by a wire coil and at least zonally elastically deflectable. The thread-leading duct can however also consist of a rigid tube or hose extending at least over a part of the needle bed length and running parallel to a thread guide guiding rail, which tube or hose is longitudinally slotted for the thread exit, and it is advantageous if the longitudinal slot of the thread-leading duct is closed by at least one sealing lip which can be opened by means of members arranged on the movable thread guide and engaging into the longitudinal slot.

The invention needed to overcome the prejudice that thread-leading ducts enveloping a thread could not be used with the thread guides of a flat knitting machine because of the plurality of guide rails running parallel to each other. Tests here have shown that this is possible after all. The thread-leading ducts have the advantage that they prevent even a relatively weakly tensioned thread from sagging and from colliding with other neighbouring threads. A further important advantage is that, by the thread-leading ducts, threads can be automatically inserted into the thread guides, for example by air intake or by means of mechanical feeder members in the thread-leading duct; and thread change devices can also be combined with the thread-leading ducts, either at the end of the thread-leading duct nearest the machine frame or—in the case of a thread-leading duct divided into several individual leading ducts—at the end of the thread-leading duct nearest the thread guide.

The following is a more detailed explanation on the basis of diagrammatic drawings of thread-leading ducts leading to the thread guide of a flat knitting machine, and in particular FIG. 1 shows a thread guide with a thread-leading duct in the form of a telescopic tube;

Figure 4:
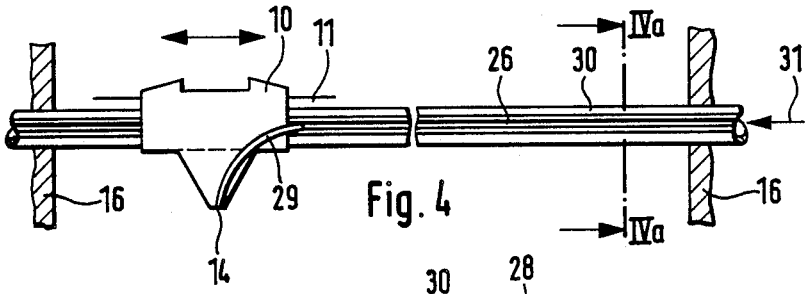
FIG. 4 shows a thread-leading duct in the form of a longitudinally slotted hose running parallel to the thread guide path.
Figure 4A:
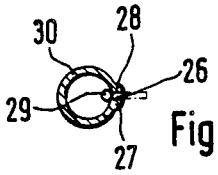
Figure 5:
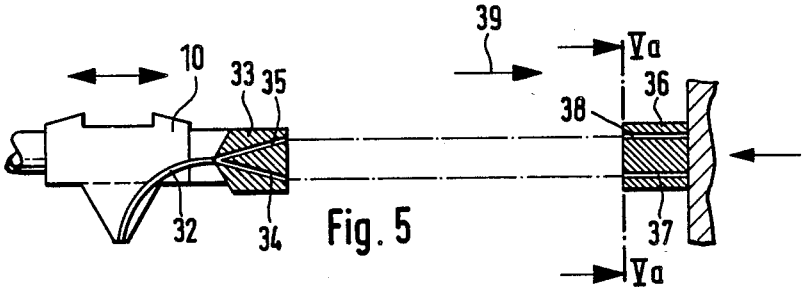
Figure 5A:
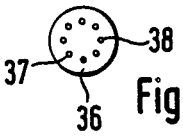

FIG. 4*a*, a cross-section through the slotted tube along the line IVa—IVa;

FIG. 5, a diagrammatic presentation of a thread guide with a thread-leading duct not extending over the whole thread leading extent and with a thread change head on the side nearest the machine frame;

FIG. 5*a*, a front end view of the thread change head.

Figure 1:
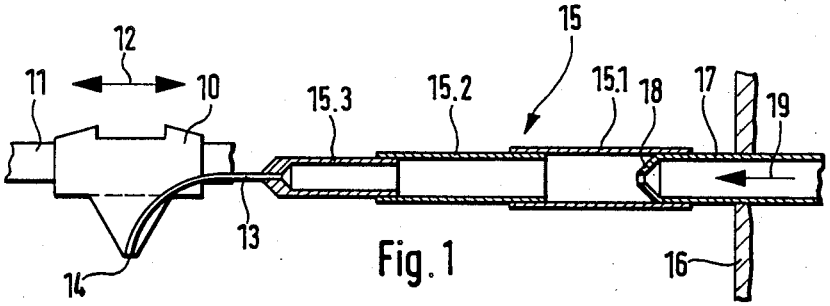

FIG. 1 shows diagrammatically a carriage-shaped thread guide 10 which, in a way known from flat knitting machines, is mounted on a guide rail 11 above the needle beds not shown here, displaceable in both directions according to the double arrow 12, i.e. it can be taken along by machine carriages not shown either. With the thread guide 10 is connected, via a small thread-leading tube 13 which ends at the thread exit point 14 of the thread guide 10, the last tube section 15.3 of a telescopic tube 15 directed parallel to the guide rail 11, which tube, in the embodiment shown, consists of three concentric tube sections 15.1, 15.2 and 15.3 which can be pushed one into another. The first tube section 15.1 is displaceably mounted on a connecting tube 17 which is permanently anchored on the machine frame 16 (only symbolically represented) and which ends in a nozzle 18 projecting into the tube section 15.1. A thread not shown is blown by means of compressed air through the connecting tube 17 and the nozzle 18 into the telescopic tube 15 and further carried along into the small thread-leading tube 13 as far as the thread exit point 14 of the thread guide 10.

Figure 2:
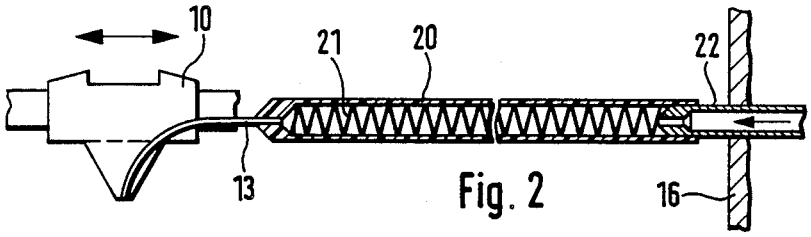
FIG. 2 shows a thread guide with a thread-leading duct in the form of a stiffened deflectable hose.

In the embodiment according to FIG. 2, the thread-leading duct consists of a plastic hose 20 which is stiffened in its longitudinal direction by a wire coil 21 but is nevertheless formed so as to be elastically extendable and elastically crushable and deflectable. The hose 20 is also, with one of its ends, firmly coupled with a thread guide 10 via a small thread-leading tube 13, while its other end is connected on a thread entry nozzle 22 stationarily fixed on the machine frame 16 of the flat knitting machine.

Figure 3:
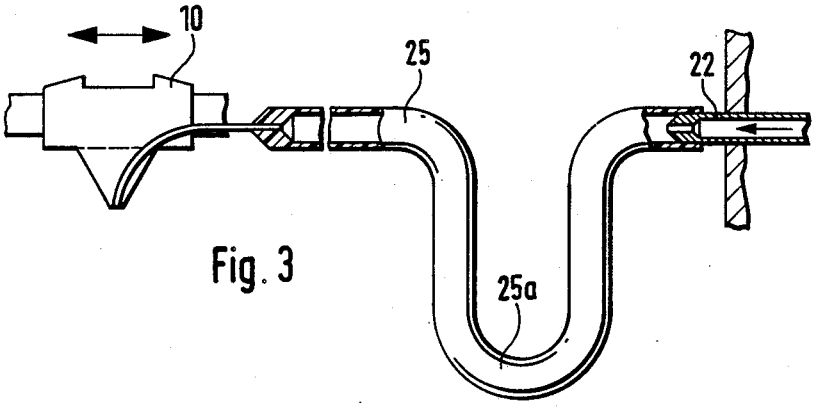
FIG. 3 shows a thread-leading duct in the form of an elastically deflectable tube.

FIG. 3 shows an embodiment related to FIG. 2 of a thread-leading duct which here has the form of an elastically deformable plastic hose 25. The plastic hose 25 is divided up, by varying wall thickness, into sections of varying rigidity, the weaker sections of which (of which one is shown) can be deflected to form a bow 25*a*. Coupling of the thread-leading duct with a thread guide 10 on the one hand and a thread entry nozzle 22 on the other hand is done as in the embodiments according to FIGS. 1 and 2.

The thread guide 10 can also be provided with a thread-leading duct from its other side. Also, several thread-leading ducts or one thread-leading duct divided into several individual leading ducts can be connected with the thread guide 10 on both sides.

In the embodiment according to FIG. 4, an inherently rigid hose 30, provided with a longitudinal slot 26, is arranged as a thread-leading duct parallel to the leading rail 11 of the thread guide 10. This hose extends over the whole length of the needle beds not shown and is fixed at both ends to the machine frame 16. As shown in the section diagram of FIG. 4*a*, the hose 30 is formed, along its longitudinal slot 26, into sealing lips 27 and 28 which normally close the longitudinal slot 26. The small thread-leading tube 29, connected with the thread guide 10 and leading to the thread exit point 14 of the thread guide 10, projects as in FIG. 4*a* into the longitudinal slot 26 and can end there in a thread-collecting funnel not shown. When the thread guide 10 travels along, the longitudinal slot 26 is opened by the small thread-leading tube 29 which leads the thread (not shown in the drawing), which is conveyed in the hose 30 in the direction of the arrow 31, out of the hose to the thread guide 10.

In the embodiment according to FIG. 5, the small thread-leading tube 32, connected with the thread guide 10, ends in a connection head 33 in which the small thread-leading tube 32 divides into several thread-leading ducts 34, 35. However, a thread guide cut as in one of FIGS. 1–3 can also be arranged between the connection head 33 and the thread guide 10. To the connection head 33 is allotted a stationary distributor head 36 which has several thread-leading ducts 37 and 38. According to FIG. 5*a* there are in total eight thread-leading ducts 37, 38 whose openings are in alignment with the openings of the thread-leading ducts 34, 35 of the connection head 33. When the thread guide 10 is moved in the direction of the arrow in FIG. 5, the connection head 33 reaches the distributor head 36 and there receives, out of one of the thread-leading ducts 37, 38, a thread injected as far as the small thread-leading tube 32. The connection head can have not more than one thread-leading duct 34 or 35 which can be brought into connection optionally with one of the thread-leading ducts 37, 38 by a rotary construction of the distributor head 36. It is also conceivable to have a thread distributing device, mounted so as to be longitudinally displaceable, with several thread-leading ducts running parallel to each other with which the connection head 33 can be optionally brought into thread injection connection.

I claim:

1. Flat knitting machine with thread guides conveyable on guide rails arranged above the needle beds and with thread-leading members for guiding the threads from the needle bed ends to the thread guides, characterised in that the thread-leading members are constructed as a thread-leading duct (15, 20, 25 30) which envelops the thread and which is adaptable, with its thread exit point on the side nearest the thread guide, to the changing distance between thread guides (10) and needle bed ends, at least one of which ducts is allotted to each thread guide (10).

2. Flat knitting machine according to claim 1, characterised in that the thread-leading duct (15, 20, 25, 30) is, with one of its ends, anchored on a stationary part (16) of the flat knitting machine and, with its other end, coupled with the thread guide (10).

3. Flat knitting machine according to claim 1, characterised in that the thread-leading duct is detachably coupled with the thread guide (10).

4. Flat knitting machine according to claim 1, characterised in that the thread-leading duct consists of a telescopic tube (15).

5. Flat knitting machine according to claim 1, characterised in that the thread-leading duct consists of a tube (25) at least zonally elastically flexible.

6. Flat knitting machine according to claim 1, characterised in that the thread-leading duct consists of a hose (20) at least zonally stiffened in its longitudinal direction by a wire coil (21) and at least zonally stretchable and deflectable.

7. Flat knitting machine according to claim 1, characterised in that the thread-leading duct consists of an inherently rigid tube or hose (30) extending at least over a part of the needle bed length of the flat knitting machine and running parallel to a thread guide guiding rail (11), which tube or hose is longitudinally slotted for the thread exit (longitudinal slot 26).

8. Flat knitting machine according to claim 7, characterised in that the longitudinal slot (26) of the thread-leading duct is closed by at least one sealing lip (27, 28) which is openable by means of members (29) arranged on the movable thread guide (10) and engaging into the longitudinal slot (26).

9. Flat knitting machine according to claim 1, characterised in that the thread-leading duct is divided into several individual leading ducts.

10. Flat knitting machine according to claim 1, characterised in that the thread-leading duct is coupled at one of its ends with a thread change device (connection head 33, distributor head 36).

* * * * *